US005359165A

United States Patent [19]

Leveque et al.

[11] Patent Number: 5,359,165

[45] Date of Patent: Oct. 25, 1994

[54] ILLUMINATED ROTARY SWITCH ASSEMBLY

[75] Inventors: Denis J. Leveque, Milwaukee, Wis.; Richard G. Johnson, McHenry, Ill.

[73] Assignee: Eaton Corporation, Cleveland, Ohio

[21] Appl. No.: 93,125

[22] Filed: Jul. 16, 1993

[51] Int. Cl.[5] ..... H01H 9/00

[52] U.S. Cl. ..... 200/317; 200/316; 200/310; 200/564; 200/565; 200/570

[58] Field of Search ..... 200/317, 316, 310, 311, 200/312, 313, 564, 565, 570, 293

[56] References Cited

U.S. PATENT DOCUMENTS

| | | | |
|---|---|---|---|
| 3,267,224 | 8/1966 | Vega | 200/564 |
| 4,221,945 | 9/1980 | Mobus et al. | 200/316 |
| 4,683,359 | 7/1987 | Wojtazek | 200/310 |
| 5,204,502 | 4/1993 | Ferris et al. | 200/313 |

FOREIGN PATENT DOCUMENTS

| | | | |
|---|---|---|---|
| 2741492 | 3/1979 | Fed. Rep. of Germany | 200/316 |
| 3533056 | 3/1987 | United Kingdom | 200/317 |

*Primary Examiner*—Henry J. Recla
*Assistant Examiner*—David J. Walczak
*Attorney, Agent, or Firm*—Roger A. Johnston

[57] ABSTRACT

An illuminated multi-position rotary selector/control switch assembly for switching substantial direct current (20 amps) at low voltages (12 V). A lower plastic housing shell is molded in a two-stage process with the first stage comprising molding platable thermoplastic resin strips and molding thereover second stage unplatable thermoplastic with exposed surface portions of said first first stage subsequently plated to form conductive strips having stationary switching contacts attached. The connector terminal pins are formed integrally with the strips in the first stage molding. The second stage thermoplastic molded thereover forms the part outline. The upper housing shell has a transparent arcuate window molded integrally therein for collecting and feeding light from a lamp to a light pipe carried by the user rotatable actuation knob.

6 Claims, 4 Drawing Sheets

ILLUMINATED ROTARY SWITCH ASSEMBLY

BACKGROUND OF THE INVENTION

The present invention relates to switches having a knob rotatable by the user for switching between a plurality of desired control positions for controlling the operation of an electrically operated appliance. The invention relates particularly to rotary switches of the type intended for switching loads such as motors operating on relatively low voltage direct current supplies as, for example, a 12-volt supply typically encountered on board automobiles.

In automotive selector or control switch applications, it has been desired to provide a user control knob actuator which is readily and easily rotatable between a plurality of control positions, and to provide for detented action in each of the desired control positions, and also to provide for illumination of indicia indicating the state of switch actuation and the control function selected at each position to facilitate nighttime operation.

Furthermore, it is often required to switch substantial current as, for example, 20 amps motor load at 12-volt DC, which is typical of starting currents in an automobile passenger compartment climate control blower motor. Thus it has been desired to provide an illuminated reliable low cost rotary selector switch for relatively high current, low voltage applications such as those encountered in automobiles, and to provide such a switch which is capable of high volume mass production, which is reliable in service, and which is low in manufacturing cost.

SUMMARY OF THE INVENTION

The present invention provides a multi-position rotary selector switch for user switching between a plurality of control positions for selecting the desired function of an appliance to be controlled. The switch assembly includes an upper and lower housing shell formed of insulating material with a plastic shaft journalled for rotation in the upper shell and extending outwardly thereof with a control knob received thereon.

The lower housing shell is formed in two stages of thermoplastic molding, a first stage of platable plastic strips in an array interconnected by molding runners. The first stage is removed from a first stage mold and inserted in a second stage mold and followed by a second stage injection of unplatable plastic which forms the part outline, leaving surface portions of the first stage strip exposed. After the second stage molding and removal from the mold, the exposed surface portions of the first stage material are plated to form discrete conductive strips which extend into a receptacle portion of the shell forming connecting terminals for external connection thereto. Each of the conductive strips has an electrical contact riveted thereto for switching between selected pairs of the contacts. The shaft has a shorting bar slidably mounted thereon carrying a pair of spaced contacts for switching between the selected pairs of stationary contacts. The shorting bar is biased against the stationary contacts by a spring carried on the shaft. The shaft also includes a spring loaded detent member which engages recesses in the undersurface of the upper housing shell when the housing shells are snap-locked together at assembly.

The upper housing shell has formed integrally therewith by insert molding a plurality of spaced translucent windows which transmit light to the outer surface from a lamp mounted on the conductive strips formed in the lower housing shell. The upper housing shell also has a second arcuately shaped transparent window formed therein; and, a transparent light pipe inserted into the knob has a light-receiving surface which moves over the arcuately shaped window with rotation of the knob to collect and transmit light to an indicia surface provided on the exterior surface of the light pipe. The present invention thus provides a rotary switch capable of handling substantial currents at low voltages, yet provides a construction which does not require attachment of discrete preformed electrical conductive strips into the housing. The present invention also provides from a single lamp backlighting of switch position-function indicia on the housing, and also provides for backlighting of the knob via a light pipe carried by the knob. The present invention thus provides a unique and novel switch construction which provides reliable operation and service, particularly with low voltage, high current loads such as in automotive blower speed control applications, and provides a fabrication technique which minimizes manufacturing costs.

DETAILED DESCRIPTION

Figure 1:
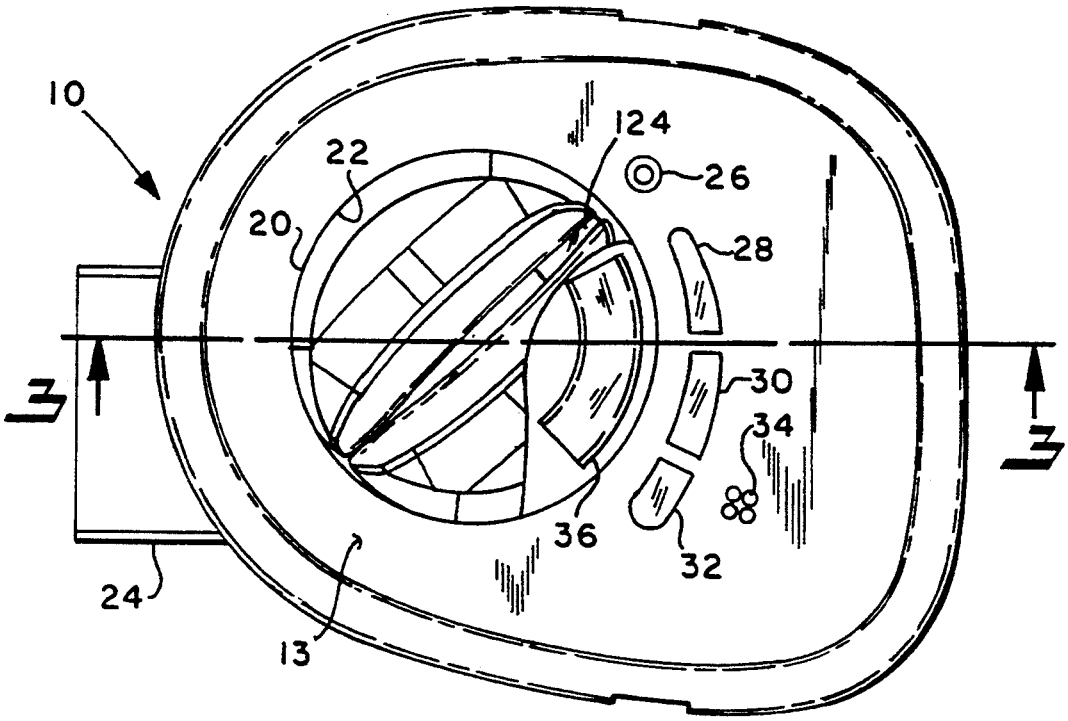
FIG. 1 is a plan or top view of the switch assembly of the present invention.
Figure 2:
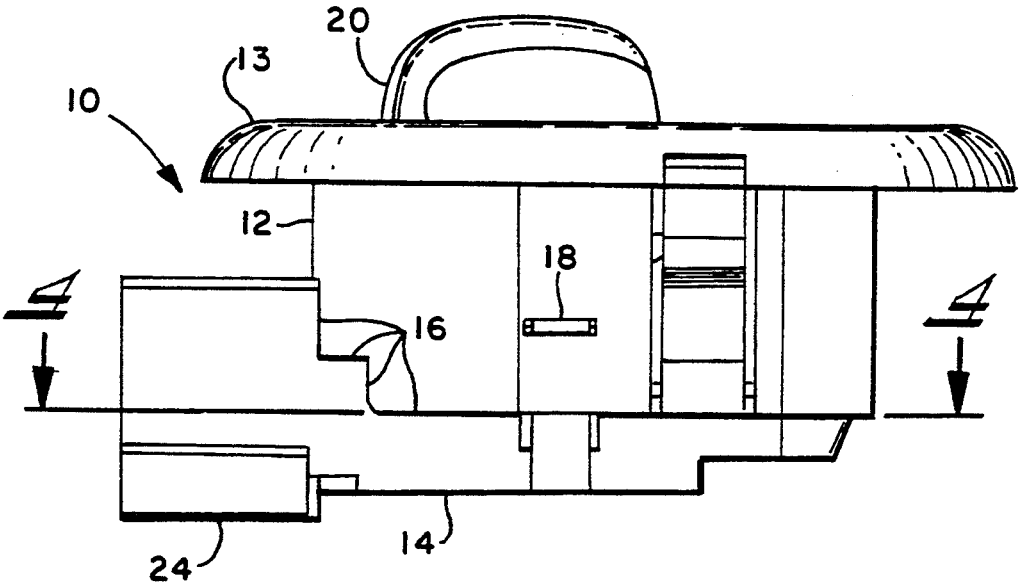
FIG. 2 is a front elevation view of the assembly of FIG. 1.

Referring to FIGS. 1 through 4, the switch assembly indicated generally at 10 has an upper housing shell 12 having a flanged deck 13 and attached to a lower housing shell 14 along a parting line 16. The upper and lower shells are secured together therealong by any suitable expedient such as, for example, snap-locking tabs 18 to form a switch housing. The switch assembly 10 has a rotatable actuator knob 20 provided on the upper surface 13 of shell 12 and recessed in a well 22, which is integrally formed with the upper shell 12.

An electrical receptacle 24 is provided, and in the presently preferred practice is integrally formed with the lower housing shell 14. Receptacle 24 contains electrical connector terminals which will hereinafter be described in greater detail.

In the presently preferred practice, the upper housing shell 12 is molded of plastic material, and has integrally molded therewith a plurality of arcuately spaced windows denoted by reference numerals 26,28,30,32,34, which are formed of, at a minimum translucent and preferably transparent, material providing indicia of switch positions on the upper surface 13 of the housing shell 12, which are illuminated by backlighting, as will hereinafter be described in greater detail.

Upper housing shell 12 has a second arcuately spaced transparent window 36 formed therein in the bottom of well 22 which has portions thereof denoted by reference numeral 40 in FIG. 3 extending below the undersurface of the well 22 formed in the upper housing shell 12. The window 36,40 is formed of translucent material at a minimum and preferably transparent material molded integrally with the upper housing shell 12 as, for example, by insert molding or a two-stage molding process. The window 36,40 has an arcuate convex shape on its upper surface 36, and a triangular cross-section on the lower projection 40. As will be described below, window 36,40 is illuminated by backlighting.

Lower housing shell 14 is formed of plastic material preferably molded in a two-stage procedure. The first stage is accomplished preferably by injection molding an array of strips of platable thermoplastic material which is capable of being subsequently plated with conductive material such as copper, nickel, or silver. In the presently preferred practice, the first stage material is formed of polyether sulfone resin mineral and glass reinforced and containing a catalytic additive to facilitate plating.

Figure 3:
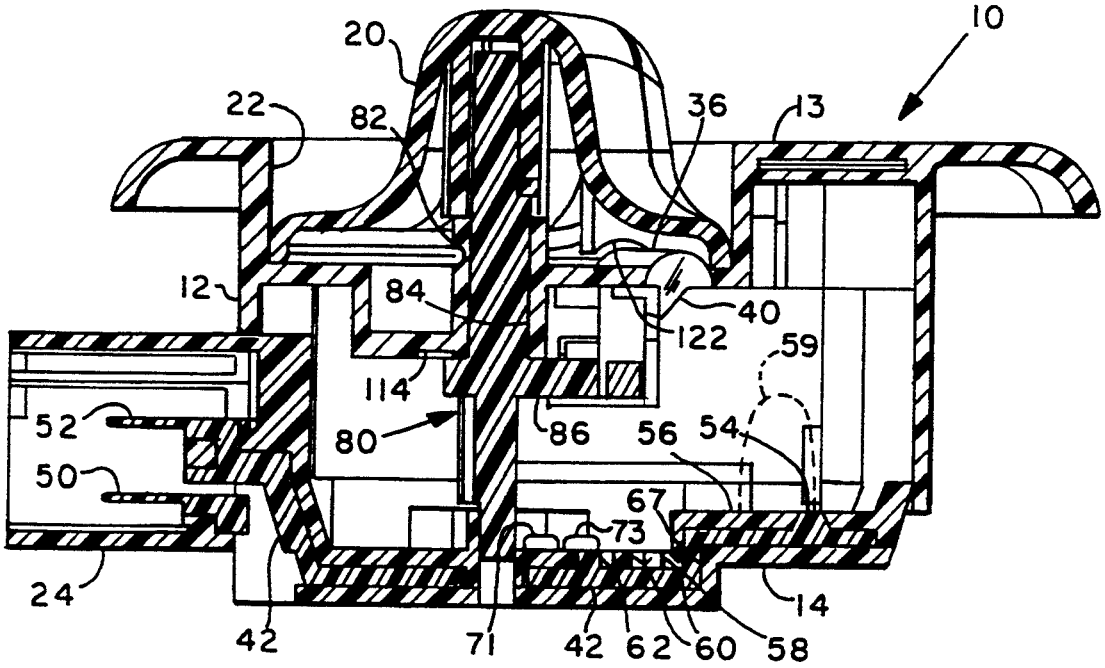
FIG. 3 is a section view, taken along section-indicating lines 3—3 of FIG. 1.
Figure 4:
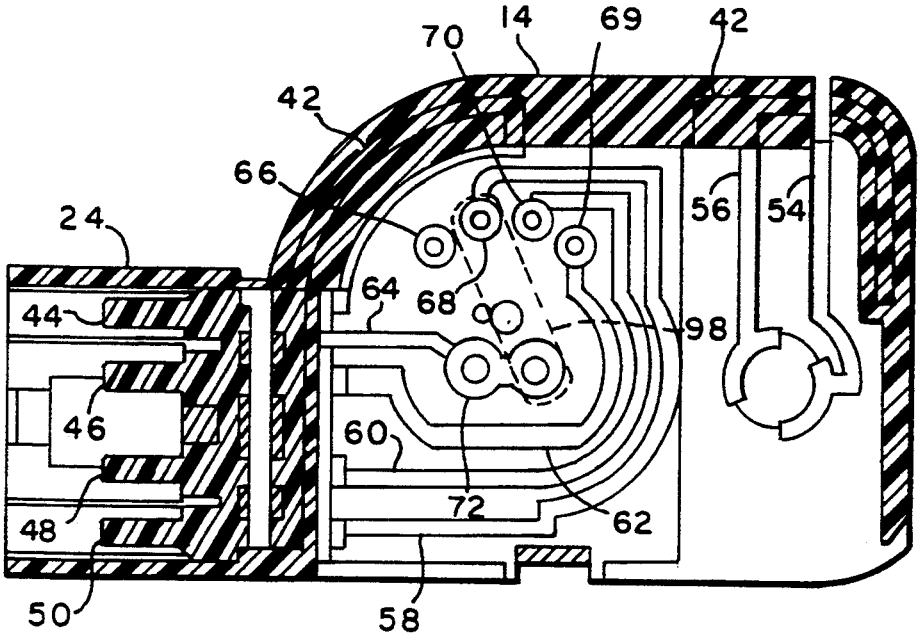
FIG. 4 is a section view, taken along section-indicating lines 4—4 of FIG. 2.
Figure 9:
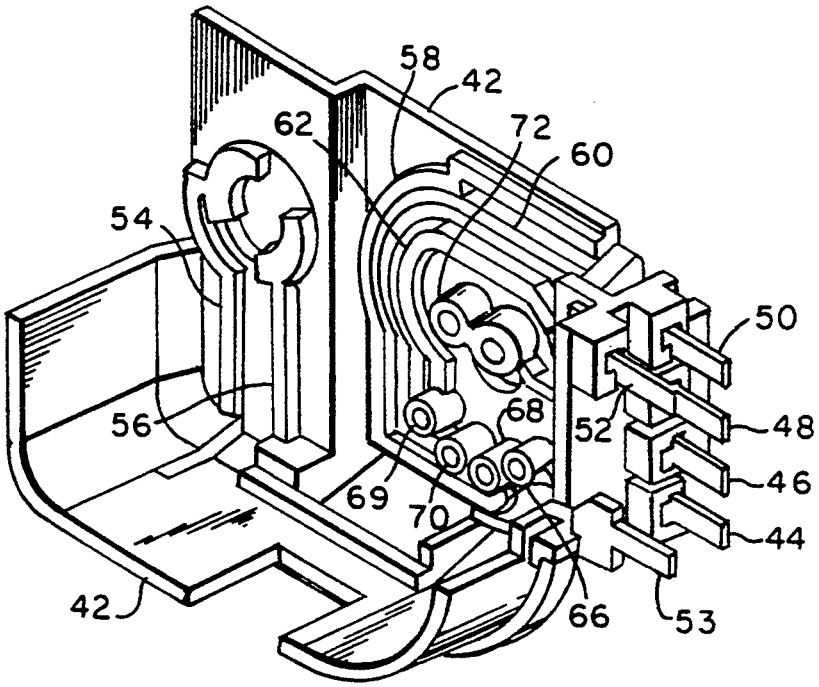
FIG. 9 is an axonometric frontal view of the first stage molded part.
Figure 10:
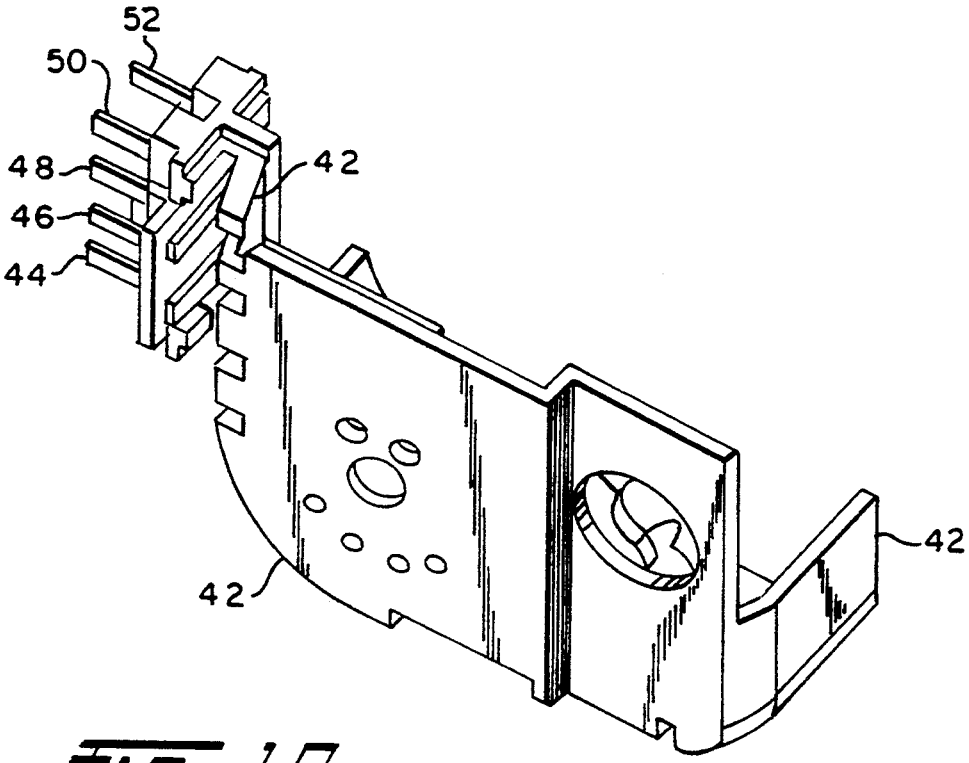
FIG. 10 is an axonometric rear view of the part of FIG. 9.

The first stage molding forms strips 54,56 for lamp power and strips 58,60,62,64 for switching; and, runners such as 42 are formed which connect to terminals 50,48,46,44 in the lower row of terminals, and the two terminals 52,53 in the upper row with only terminal 52 of the upper row shown in FIGS. 3 and 10, and with both terminals 52,53 shown in FIG. 9.

The part is then removed from the mold and inserted into a second stage mold; and, the second stage plastic is injected, which forms the basic part outline of the lower shell about the array of first stage strips. Preferably, the second stage material is a blend of acrylnitrile butadiene styrene and polysulfone. One suitable second stage material is available from Amoco Performance Products, Inc., 380 Grove Street, Ridgefield, Conn. 06877, with manufacturer's designation 5-1000; other materials, however, may be employed. Strips 54,56 are adapted to have attached thereto an illuminating lamp means 59 shown in dashed outline in FIG. 3 by any suitable expedient well known in the art for providing power thereto. Each of the strips 58,60,62,64 has exposed surface portions which terminates in an end ring denoted respectively by reference numerals 68,70,69 for the terminal strips 58,60,62. Terminal strip 64 has a double ring 72 provided at the end thereof which serves as a common terminal; and, stand-alone ring 66 is an OFF position. Rings 66,68,70,72 are disposed in a spaced arcuate arrangement, and each has attached thereto a riveted electrical contact, typically as denoted by reference numerals 71,73 in FIG. 3, but which are omitted for clarity in FIG. 4.

Upon completion of the second stage molding, the lower housing shell is removed from the second stage mold. The surfaces of the strips of material are then chemically treated and plated with conductive material as, for example, by immersion plating of copper thereon by known techniques. If desired, overplating may be applied with a material such as nickel, tin, or gold to enhance solderability, durability, and corrosion resistance. The molding of the platable resin material 42 and the plating thereon may be obtained from Mitsui-Pathtek Corporation, 250 Metro Park, Rochester, N.Y. 14623. It will be understood, however, that any other suitable source may be employed for the two-stage molding process, with the first stage material employing a plastic resin treated for subsequent plating of electroconductive material thereon.

Referring to FIGS. 9 and 10, the part configuration of the platable material upon removal from the mold after the first stage molding operation is illustrated showing the integrally formed terminal connectors 44–53 and interconnecting strips.

Referring to FIG. 3, the contact riveted to conductive strip end 70 is denoted 71, and reference numeral 73 denotes the contact riveted to the conductive strip end 72.

Figure 5:
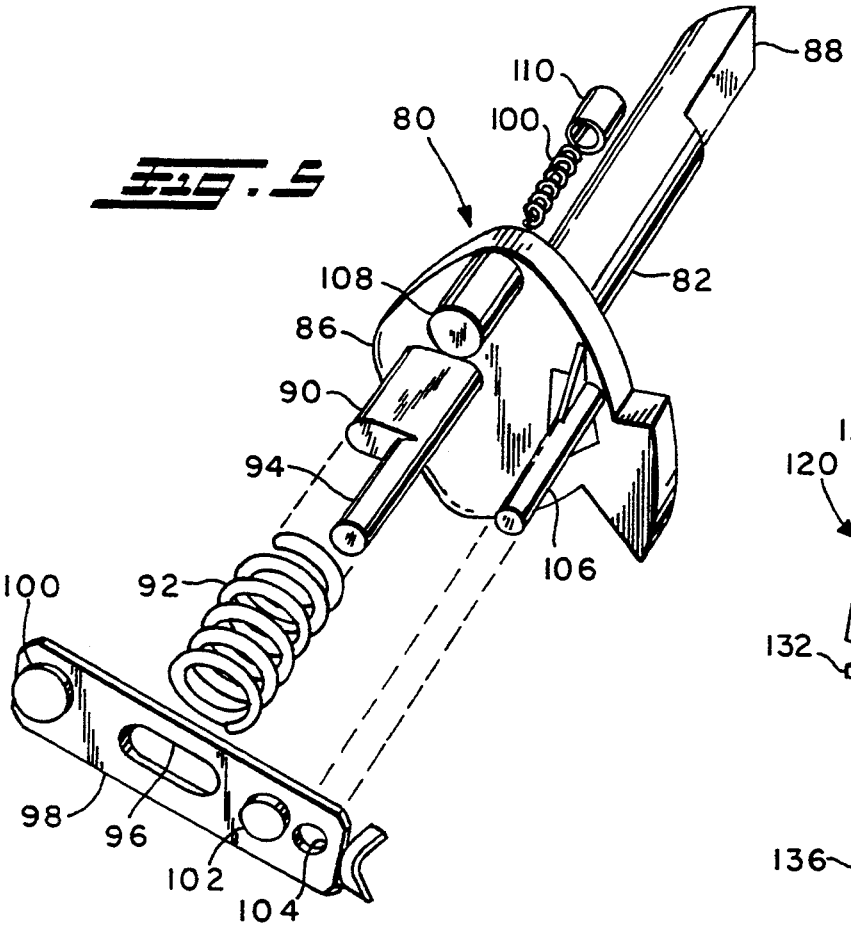
FIG. 5 is an axonometric exploded view of the switch shaft subassembly.
Figure 8:
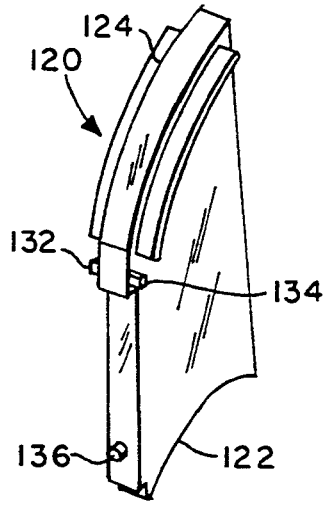
FIG. 8 is an axonometric view of the light pipe insert for the knob.
Figure 6:
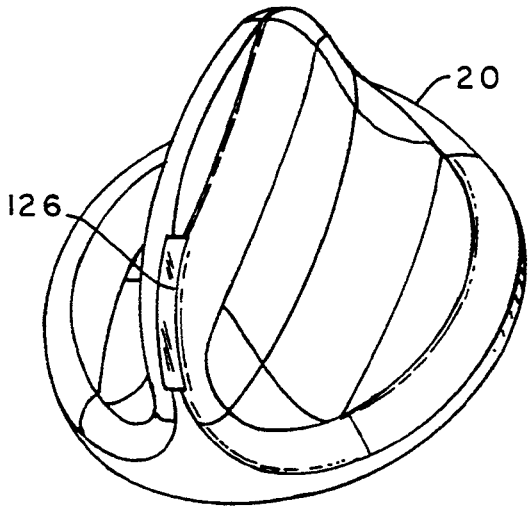
FIG. 6 is an axonometric view from above the switch knob for the assembly of FIG. 1.

Referring to FIGS. 3 and 5, the rotatable switching shaft subassembly is indicated generally at 80, and has a relatively small diameter cylindrical shaft portion 82, which is journalled for rotation in a sleeve or bearing 84 which is integrally formed in the well 22 of the upper housing shell 12. Shaft 82 has attached thereto an enlarged diameter radial flange 86 at the lower end thereof. Shaft 82 has a flat portion 88 provided on the upper end thereof for engagement with user knob 20.

Flange 86 has formed integrally therewith and extending downwardly therefrom a guide lug or projection 90, which has received thereover a contact spring 92. Lug 90 has extending downwardly therefrom a reduced diameter pin portion 94 which extends through the spring 92. A contact or shorting bar 98 is provided having a slot 96 formed therein received over pin 94. Bar 98 has the lower end of spring 92 registered thereagainst; and, the upper end of spring 92 is registered against the axial face of flange 86 and serves to bias the bar 98 in a downward direction. Bar 98 has a pair of spaced electrical contacts 100,102 riveted thereto, and has an aperture 104 provided therethrough adjacent contact 102. Flange 86 has a drive pin 106 formed integrally therewith and extending downwardly therefrom, which slidably engages the aperture 104 in bar 98 such that rotation of shaft 82 causes the pin 106 to positively rotate the bar 98.

Flange 86 has a projection or lug 108 extending downwardly therefrom, and lug 108 is hollow and open to the rear face of flange 86. A detent spring 100 has one end received in the hollow of lug 108; and, a button 110 received slidably over the opposite end of the spring which extends outwardly from the hollow Button 110 is operable to engage a plurality of spaced detent recesses provided in the undersurface of the upper housing shell 12, one of which recesses is illustrated and denoted by reference numeral 114 in FIG. 3.

In operation, as shaft 82 is rotated, the spring biased button 110 is operable to engage various ones of the recesses, such as recess 114, to detent the shaft to the desired selected rotary position. In the presently preferred practice, the shaft 82, flange 86, lug 90, pin 106 and projection 108 are all formed integrally of molded plastic material. Bar 98 is typically formed of a conductive metal such as copper. The position of the shorting bar 98 is illustrated by dashed outline in FIG. 4 in one of the switching positions as electrically connecting conductive strip end 72 with conductive strip end 68; and, further details thereof have been omitted in the drawings for clarity of illustration. It will be understood, however, that the bar 98 is rotated as between positions interconnecting the conductive strip end 72, which has double contacts riveted thereto, with any of the strip ends 66,68,70,69 with the contact position associated with the strip end 66 comprising the "OFF" position.

Figure 7:
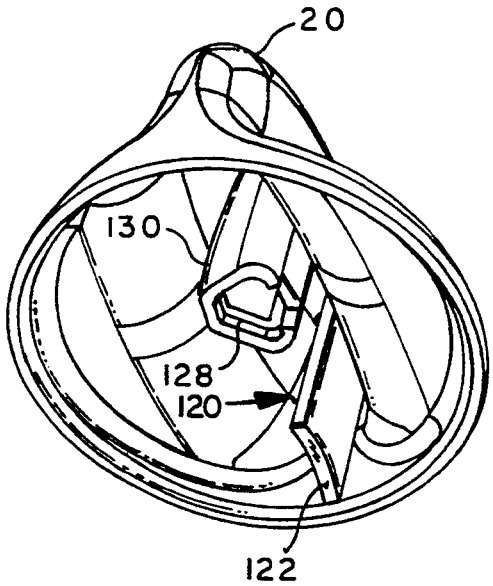
FIG. 7 is a view similar to FIG. 6 of the underneath of the knob of the assembly of FIG. 1.

Referring to FIGS. 3, 6, 7, and 8, the knob 20 is shown as having a transparent light pipe indicated generally at 120 which has a light-receiving or collecting arcuate by configured surface 122 on the underside thereof and a convex light transmitting surface 124 on the upper end thereof. The light pipe 120 in the presently preferred practice is insert molded into knob 20, or alternatively as a separate molded part is assembled in a slot 126 formed in knob 20 such that light transmitting surface 124 is flush with the upper surface of the knob. The light receiving surface 122 of light pipe 120 extends downwardly into the interior of the knob and adjacent the lower rim thereof, as shown in FIGS. 3 and 7, with the surface 122 spaced closely adjacent the surface 36 of the arcuate window 36,40 throughout the rotation of knob 20. Thus, the light pipe 120 functions to collect light from window surface 36 and transmits the light upwardly to the illuminating surface 124 to provide the user with an indication of the rotary position of the knob 20. Light pipe 120 is molded of transparent plastic and preferably positioned as an insert in a mold and the opaque material of the knob 20 molded thereover.

Referring to FIG. 7, a metal clip 128 is received in the hollow interior of hub 130 formed on the underside of knob 20. Clip 128 is barbed to secure retention in the hub 130 to provide frictional engagement with the flat surface 88 on shaft 82 to insure positive rotation of the shaft and prevent inadvertent removal of the knob.

The present invention thus provides an illuminated rotary switch for handling substantial flow of direct current at low voltages, and which is illuminated for night-time use and is provided with detent action for the selected positions. The switch assembly of the present invention has the stationary conductive strips for connection of the stationary switching contacts formed integrally with the external connecting contact terminals of the switch assembly by dual stage molding of plastic material. The first stage comprises molding an array of strips of platable thermoplastic forming connector terminals integrally therewith. The second stage comprises molding unplatable thermoplastic over the first stage array with selected surface portions of the strips of the first stage molded part exposed. The exposed parts of the first stage material of the molded shell and terminals are then plated with conductive metal to form conductive strips connected to the terminals. Stationary switching contacts are then attached to the ends of the strip. Separate placement of individual electrically conductive metal contact strips or insert molding of such metal conductive strips by individual placement thereof in a mold is thus eliminated.

Although the invention has been described and illustrated with respect to one embodiment and the presently preferred practice, it will be understood that the invention is capable of modification and variation and is limited only by the following claims.

We claim:

1. An illuminated rotary switch assembly comprising:

(a) housing means, including upper and lower shell portions joined along a parting line and operative to define a receptacle portion having a plurality of connector terminals for external connection thereto;

(b) said lower shell portion having a first section with an array of protruding strips formed of platable thermoplastic material, and a second section formed of unplatable thermoplastic material molded thereover, said strips being plated with conductive material to form electrical conductors, a first end of each strip having a fixed contact attached thereto and an opposite end of each strip connected to said connector terminals;

(c) said upper shell means molded of opaque material with translucent windows molded integrally therewith for providing indicia for indicating switch operation functions;

(d) shaft means journalled for rotation in said housing means and extending through said upper housing portion and having thereon a knob for facilitating user rotating of said shaft means;

(e) movable contact means associated with said shaft means and operable, upon user rotation of said shaft means, to effect switching between individual pairs of said contacts; and, (f) lamp means operably connected to said conductors operable to illuminate said windows in said upper shell portion.

2. The assembly defined in claim 1, wherein said upper portion includes a second translucent window, and said user knob includes a transparent light pipe receiving light from said second window for illuminating a portion of said knob.

3. The switch assembly defined in claim 1, wherein said upper shell portion includes a second translucent window integrally molded therein having an arcuate transmitting surface; and, said knob includes a transparent light pipe movable therewith having a receiving surface adjacent said arcuate transmitting surface.

4. The switch assembly defined in claim 1, wherein said lower shell portion has said receptacle portion formed integrally therewith.

5. The switch assembly defined in claim 1, wherein said shaft means includes means operable to detent each contact pair position for said switching.

6. The switch assembly defined in claim 1, wherein said shaft means and said knob are formed of plastic material and said knob includes a barbed metal insert for frictionally retaining said knob on said shaft means.

* * * * *